US005285757A

United States Patent [19]

Entenmann et al.

[11] Patent Number: 5,285,757

[45] Date of Patent: Feb. 15, 1994

[54] ARRANGEMENT FOR CONTROLLING AN ACTUABLE ELEMENT IN A MOTOR VEHICLE HAVING A DRIVE UNIT

[75] Inventors: Robert Entenmann, Benningen; Claus-Dieter Nusser; Jochen Stahl, both of Schwieberdingen; Albert Gerhard, Tamm; Erhard Renninger, Markgröningen, all of Fed. Rep. of Germany

[73] Assignee: Robert Bosch GmbH, Stuttgart

[21] Appl. No.: 969,978

[22] Filed: Nov. 2, 1992

[30] Foreign Application Priority Data

Oct. 31, 1991 [DE] Fed. Rep. of Germany ..... 4135913

[51] Int. Cl.[5] ..... F02D 11/10

[52] U.S. Cl. ..... 123/399

[58] Field of Search ..... 123/361, 399

[56] References Cited

U.S. PATENT DOCUMENTS

| | | | |
|---|---|---|---|
| 4,506,642 | 3/1985 | Pfalzgraf et al. | 123/361 |
| 4,909,213 | 3/1990 | Mezger et al. | 123/399 X |
| 5,078,110 | 1/1992 | Rodefeld | 123/399 |
| 5,146,886 | 9/1992 | Mannle et al. | 123/399 X |
| 5,167,212 | 12/1992 | Peter et al. | 123/399 |
| 5,213,078 | 5/1993 | Kolberg et al. | 123/399 |

FOREIGN PATENT DOCUMENTS 3327376 7/1985 Fed. Rep. of Germany .

*Primary Examiner*—Willis R. Wolfe

*Attorney, Agent, or Firm*—Walter Ottesen

[57] ABSTRACT

The invention is directed to an arrangement for controlling an actuable element in a motor vehicle equipped with a drive unit. The arrangement includes an actuable element movable over a maximum possible operating range between two outermost limits including a normal operating work range within the limits; an electrically actuable actuating device for controlling the actuable element; a control unit for generating actuating signals for controlling the actuable element and for supplying the actuating signals to the actuating device; the control unit is adapted to generate the signals so as to cause the actuable element to move over most of the maximum possible operating range in a manner to prevent jammings with the actuable element being moved outside of the normal operating work range at least beyond one end of the normal operating work range; the actuable element being moved starting from a desired position for every possible direction of movement; and, the actuable element being moved at least at one of the following times: ahead of the start of the drive unit and after the drive unit has been switched off.

11 Claims, 3 Drawing Sheets

ARRANGEMENT FOR CONTROLLING AN ACTUABLE ELEMENT IN A MOTOR VEHICLE HAVING A DRIVE UNIT

BACKGROUND OF THE INVENTION

U.S. Pat. No. 5,078,110 discloses an arrangement for controlling an actuable element wherein the control unit generates an actuating signal when a jamming of the actuable element has been detected. The actuating signal leads to a shaking movement of the actuable element. In this way, an effort is made to loosen the jammed actuable element after the jamming condition is detected and maintain the availability of the motor vehicle equipped with the actuable element. The measures described in U.S. Pat. No. 5,078,110 are initiated after jamming is detected. In this way, there is only a short operating phase during which the availability of the motor vehicle is limited.

From published German patent application 3,327,376 it is known, in order to avoid jamming or tilting of an actuable element (throttle flap), to move the actuable element out of the rest position by allowing the engine to cool after the engine is switched off. Here, it is not considered that the jamming can be caused also by the collection of dirt at the end of the normal range of movement. The danger of jamming by such accumulations of dirt is not avoided by the procedure described in published German patent application 3,327,376.

Published German patent application 4,018,922 discloses that layers of dirt on potentiometer tracks can be removed in pregiven operating states such as during overrun operation. The actuable element connected to the potentiometer is moved in one direction out of the normal operating range and so pushes the contaminants out of the normal operating range. Although contamination is removed from the potentiometer tracks in this way, a jamming of the actuable element itself is only inadequately countered.

SUMMARY OF THE INVENTION

It is an object of the invention to configure an arrangement for controlling an actuable element in a motor vehicle equipped with a drive unit in such a manner that a jamming of this actuable element is effectively countered in a preventive manner and without affecting the normal operation of the motor vehicle.

This is achieved in that the control unit which generates the actuating signals for controlling the actuable element is so configured that, before starting and/or after switching off the drive unit or the motor vehicle, the actuable element is moved at least once over the greater portion of its maximum possible range of movement in such a manner that jamming is prevented with the actuable element being guided at least to one end outside of its normal range of operating movement. The movement of the actuable element is started from any desired position for each possible direction of movement.

U.S. Pat. No. 4,506,642 discloses moving the actuable element to both end positions before the engine is started in order to learn the maximum possible positioning range. Preventive measures against jamming are not described.

The procedure of the invention assures a preventive avoidance of jamming of an actuable element without affecting normal operation of the motor vehicle.

Accumulated dirt which can lead to a jamming of the actuable element is removed especially by the movement of the actuable element over the entire range of movement even outside of the normal operating range, that is, the range passed over in normal operation. In this way, good operation of the actuable element is ensured.

It is advantageous to not only carry out the preventive movement once but several times.

With the procedure of the invention, contamination problems for actuable elements are countered especially for elements for influencing the engine capacity such as a throttle flap or an injection pump and preferably for an idle element and especially for a bypass element.

Carrying out the movement before the start and/or after the engine is switched off or, if required during overrun operation, does not affect the normal operation of the motor vehicle.

The control of the actuable element during this movement at high torque is especially advantageous especially at maximum torque and/or maximum speed.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
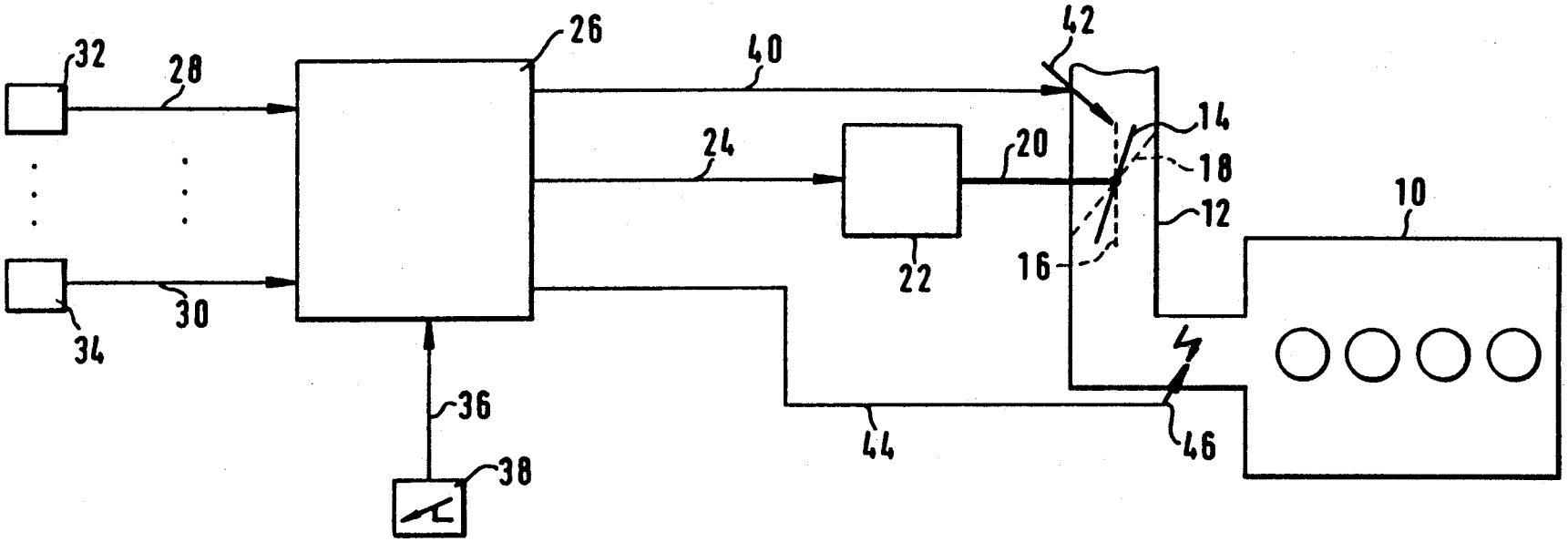
FIG. 1 is a block diagram of an arrangement for controlling an actuable element in a motor vehicle equipped with a drive unit.

FIG. 1 shows an internal combustion engine 10 having an air-intake system 12 in which the actuable element 14 is mounted. The actuable element is movable between a maximum position 16 (fully opened) and a minimum position 18 (fully closed). The actuable element 14 is connected via a mechanical transmission 20 to an electrically-actuable actuator device 22 which is supplied with drive signals via a drive line 24 from a control unit 26. Operating variables of the internal combustion engine and of the motor vehicle are supplied to the control unit 26 via the input lines 28 to 30 from corresponding measuring devices 32 to 34, respectively. In addition, a signal representing the position of the ignition switch is supplied via the input line 36 from the ignition switch 38. A further output line 40 connects the control unit 26 to an actuator device 42 for metering fuel (or actuator devices 42 corresponding to the number of cylinders) while a third output line 44 connects the control unit 26 to an actuator device 46 for adjusting the ignition angle.

In addition, the control unit 26 includes a circuit such as is known from the state of the art as described in published German patent application 3,327,376 by means of which the complete operability of the control system and especially the drive of the actuator device is maintained after switching off the engine or the motor vehicle.

The operability of this arrangement is explained below with respect to idle control. The procedure provided by the invention is however not limited to idle-control systems; instead, the procedure is applicable also to throttle flap controls or injection pump controls for Otto engines or diesel engines (electronic gas pedal, drive-slip control and the like).

The procedure of the invention can be applied in an advantageous manner everywhere in the motor vehicle where an electrically-actuable actuating device is subjected to contamination which can affect the operability of the actuating device.

In normal operation, an idle closed-loop control (position closed-loop control, engine-speed closed-loop control, charging closed-loop control) or open-loop control can be undertaken by means of the position of the actuable element 14. The actuable element has a normal operating range in which the actuable element is moved in average operating cases. This operating range is as a rule less than the maximum range of movement of the actuable element between the maximum position 16 and the minimum position 18 and lies within this maximum range of movement. A desired value for the idle engine speed, the position of the actuable element or the charge is obtained in the control unit 26 from a table or a characteristic field from the operating variables supplied via the input lines 28 to 30 from the measuring devices 32 to 34, respectively. Operating variables included are those known from the state of the art such as engine temperature, motor vehicle speed, engine speed, battery voltage, transmission position, etcetera. For electronic gas-pedal systems, the position of the operator-actuated element is also considered and in drive-slip control at least the wheel speeds are considered.

In dependence upon the particular embodiment, a changing drive signal is emitted by the control unit 26 on the output line 24 (the drive signal corresponds to the desired value formed for adjusting the actuable element via the actuator device 22) or the formed desired value is set into relationship to the actual value of the engine speed and/or the actual value of the position of the actuable element to form the control deviation. In the last case, a drive signal is generated from the control deviation in correspondence to known controller equations. This drive signal adjusts the actuable element 14 in the sense of a control of the actual value to the desired value. In parallel to the foregoing, the control unit 26 sets the fuel metering and ignition angle of the engine 10 in a known manner via line 40 and actuator device 42 and via line 44 and actuator device 46.

The drive signal is changeable in all directions of movement up to a maximum amount which moves the actuable element with maximum torque or maximum speed. The drive signal can be a signal having a changing pulse-duty factor, a current signal or a voltage signal.

The actuable element 14 shown is subjected to contaminants because of its arrangement in the air-intake system 12 of the engine, for example, because of exhaust gas as a consequence of valve overlappings of the cylinders or because of venting of the crankcase. The contaminants become fixedly deposited in the regions of the range of movement of the actuable element 14 which lie outside of the normal operating range and to which the actuable element is only seldom driven. For this reason, the danger is present that the actuable element becomes jammed because of collected dirt in the region of minimum and/or maximum position. In order to remove this dirt, the actuable element is at least once opened and closed with a large torque, preferably the maximum torque before the start and/or after the engine or vehicle is switched off. This ensures the operability of the actuable element.

The control unit 26 detects the prestart phase and/or the shutoff of the engine by evaluating the position of the ignition switch which is supplied by the measuring device 38 via the line 36. In these operating phases, the above-described closed-loop or open-loop control of the actuable element is not carried out so that the control unit 26 moves the actuable element, from any desired position, for every possible direction of movement at least once over the greater portion of its maximum possible range of movement so that the actuable element is guided to at least one end outside of its normal range of operating movement. For this purpose, the control unit 26 guides the actuable element once or several times and preferably with maximum torque into the open and closed positions pursuant to a pregiven time plan. If the position of the actuable element is detected by a corresponding measuring device, then the sequence of movement can be controlled also by pregiven position values. That is, a pregiven drive quantity is maintained until a pregiven position of the actuable element is reached.

Figure 2:
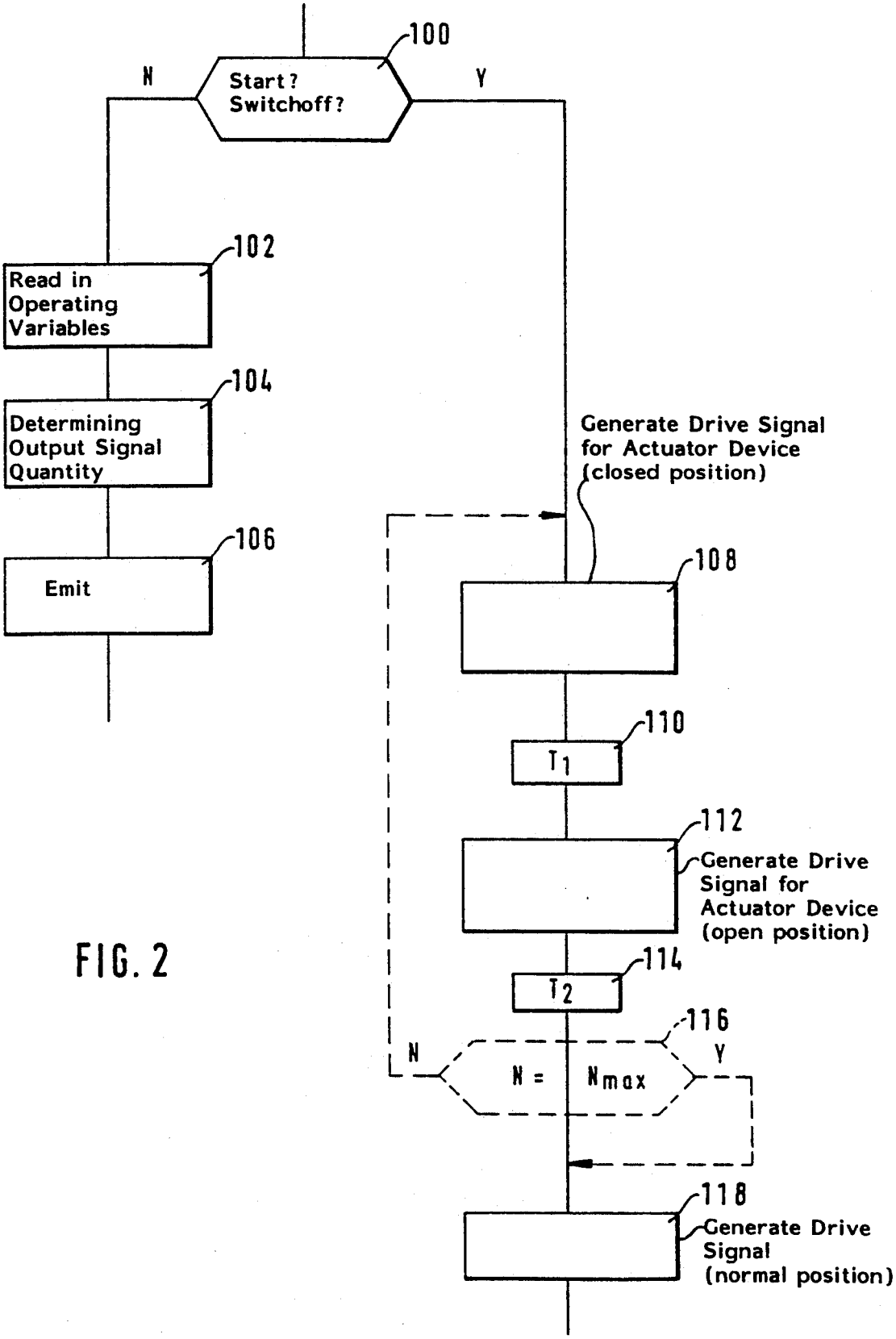
FIG. 2 is a flowchart for carrying out the procedure according to the invention; and, FIG. 3*a* shows a waveform of the drive signal

The program for the foregoing which runs in the control unit 26 is outlined by the flowchart provided in FIG. 2.

The subprogram of FIG. 2 is started at the beginning of the operating cycle at the closure of the ignition switch. In a first inquiry step 100, a check on the basis of a changeable mark is made as to whether a first start of the subprogram and therefore of the prestart phase of the motor vehicle is present. This mark is set to a pregiven value by the initialization carried out by the control unit when switching on as a consequence of the closure of the ignition switch. The mark is set back after carrying out the subprogram for the first time and is reset again to the pregiven value after switching off the engine or motor vehicle by opening the ignition switch.

The pregiven value of this mark therefore shows the prestart phase as well as the after-switchoff phase with the driveability of the actuable element being maintained for a certain time after switchoff as mentioned above.

If the determination is made in inquiry step 100 that the system is in the normal operating state, then, in step 102, the above-mentioned operating variables are read in and the desired value for the position of the actuable element 14 is formed from these operating variables from a table or a characteristic field. In the following step 104, the drive-signal quantity is determined in correspondence to the procedure outlined above and, in step 106, the drive-signal quantity is supplied via the line 24 to the actuator 22. Thereafter, the program part is repeated at a pregiven time.

If in inquiry step 100 on the basis of the mark, the determination is made that the engine is in the prestart phase or is in the phase after switchoff, a drive signal for the actuator device 22 is generated and emitted in step 108 having a magnitude which is a maximum value and guides the actuable element 14 in the direction of its minimum position 18. After a pregiven time $T_1$ has run according to step 110, a drive signal having maximum magnitude is determined and emitted in a corresponding manner in step 112. This drive signal guides the actuable element 14 into its fully opened position 16.

A signal having a changeable pulse-duty ratio for each direction of movement is preferably provided as a drive signal. This drive signal is however dependent upon the type of actuator device 22 so that the procedure outlined in the other embodiments can be applied also in combination with other drive concepts such as for step motors or current control driven actuator devices.

After a further pregiven time $T_2$ has run in accordance with step 114 and after driving the actuable element 14 at maximum torque, an inquiry step 116 can be provided wherein a counter N running at the same time can be interrogated as to whether the maximum pregiven number $N_{max}$ of opening and closing movements has been carried out. If this is not the case, then the subprogram is repeated starting with step 108; whereas, in the opposite case where only a one-time back and forth movement is provided, the program is continued with step 118.

In this step, a drive signal is generated which, for reasons of safety, guides the actuable element 14 into a normal position. In this way, the condition is avoided wherein the actuable element becomes stuck in the fully-open position.

Thereafter, the subprogram is ended and is repeated after a pregiven time has run.

The embodiment described above shows only one advantageous configuration of the procedure provided by the invention.

It can be advantageous not to carry out the above-mentioned procedure in every prestart phase or after every switchoff of the engine; rather, to carry out the procedure at pregiven intervals or after a pregiven number of operating cycles in dependence upon operating time. For this purpose, appropriate counters are interrogated in accordance with inquiry step 100 with the described routine of steps 108 to 118 only then being initiated when the pregiven count of the counter is reached.

Accordingly, in the other embodiments, the described procedure is not carried out in each prestart phase or after each switchoff. Furthermore, the procedure can be carried out only in prestart phases or after the switchoff.

The procedure provided by the invention can advantageously be carried out in addition to or only during overrun operation. Overrun operation is detected when the accelerator pedal is released and the engine speed lies above a pregiven value.

In addition, and in lieu of the pregiven maximum values of the drive signal for driving the actuable element back and forth, constant values can advantageously be provided which ensure a reliable movement of the actuable element in the direction of its extreme positions. Values can then advantageously be provided which lead to a maximum drive torque of the actuable element. Other values can also be advantageous in specific embodiments.

The movement of the actuable element can also be interrupted in the vicinity of the extreme positions. It is only essential to drive the actuable element out of its normal operating range.

The pregiven times in steps 110 and 114 are determined in such a manner that in this time the actuable element is in each case moved from one extreme position into the other extreme position or the proximity thereof depending upon the selected drive signal.

Figure 3:
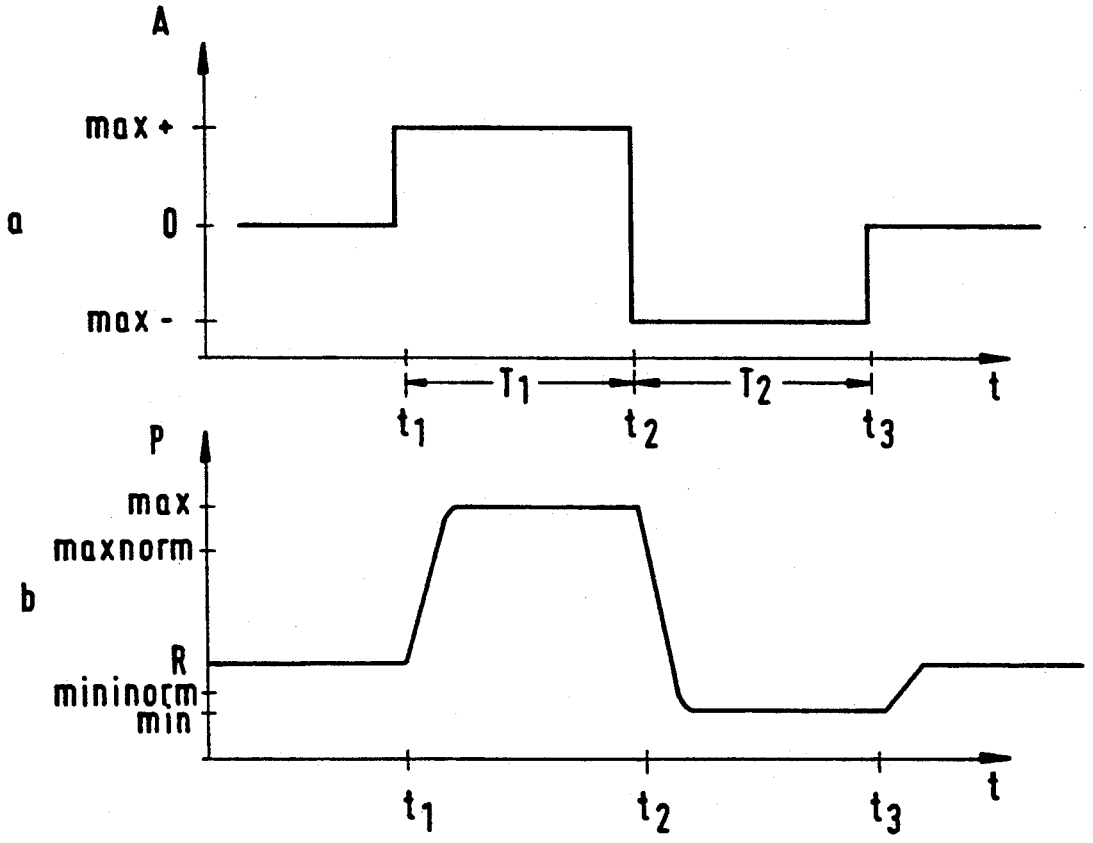
FIG. 3*b* is a waveform of the position of the actuable element.

FIG. 3*a* shows an exemplary waveform of the drive signal and FIG. 3*b* shows an exemplary waveform of the position of the actuable element.

In FIG. 3*a*, the drive signal quantity A is shown perpendicular to the time axis. The drive signal changes between the maximum value max+ for the first direction of movement and max− for the second direction of movement. The actuable element assumes a pregiven rest position for A=0. In FIG. 3*b*, the position P of the actuable element is shown perpendicular to time. The position changes between two extreme values (max) and (min) limited by stops and the normal operating range lies between the values maxnorm and minnorm. Reference character R identifies the rest position.

Up to time point $t_1$, the drive signal quantity is 0 and the actuable element is in its rest position R. At time point $t_1$ (after switchoff, in the prestart phase or in overrun), the drive signal quantity is set to its maximum value max+. This causes a slow movement of the actuable element out of its normal operating range up to its position max. After the time $T_1$ has run at time point $t_2$, the drive quantity is set to the value max− and the actuable element is guided into the position min. After time $T_2$ has run at time point $t_3$, the drive quantity changes to 0 and the actuable element goes into its rest position.

The actuable element can first move into the position min and then be guided into the position max.

The start position of the actuable element can also deviate from the rest position and any desired position can be the start position.

In addition, the drive value 0 must not correspond to the rest position of the actuable element.

The linear time-dependent changes are only exemplary. Other time traces can be selected for other embodiments.

In addition, the actuator device can be different electrical motors such direct-current motors, step motors or asynchronous motors. The procedure of the invention can be combined with all these motors in an advantageous manner.

It is understood that the foregoing description is that of the preferred embodiments of the invention and that various changes and modifications may be made thereto without departing from the spirit and scope of the invention as defined in the appended claims.

What is claimed is:

1. An arrangement for controlling an actuable element in a motor vehicle equipped with a drive unit, the arrangement comprising:

an actuable element movable over a maximum possible operating range between two outermost limits including a normal operating work range within said limits;

an electrically actuable actuating device for controlling the actuable element;

a control unit for generating actuating signals for controlling said actuable element and for supplying said actuating signals to said actuating device;

said control unit including means for generating said signals so as to cause said actuable element to move over most of said maximum possible operating range in a manner to prevent jammings with said actuable element being moved outside of said normal operating work range at least beyond one end of said normal operating work range;

said actuable element being moved starting from a desired position for every possible direction of movement; and, said actuable element being moved at least at one of the following times: ahead of the start of the drive unit and after the drive unit has been switched off.

2. The arrangement of claim 1, said actuable element being one of the following: a throttle flap, an idle positioning device, a bypass valve and an injection pump.

3. The arrangement of claim 1, said maximum possible operating range being delimited by two extreme values (max and min) of the position of said actuable element; and, said normal operating work range corresponding to average operating states.

4. The arrangement of claim 3, wherein a control of the actuable element first takes place in the direction of one of the two extreme values and then in the direction of the other one of the two extreme values before said start or after the drive unit is switched off.

5. The arrangement of claim 1, wherein the value of the drive signal for moving the actuable element is selected so as to cause said actuable element to drive at maximum torque.

6. The arrangement of claim 1, wherein the value of said drive signal assumes maximum values.

7. The arrangement of claim 1, wherein the control of said actuable element takes place after at least one of the following: a pregiven number of operating cycles and a pregiven operating time of the motor vehicle.

8. The arrangement of claim 1, wherein the control of the actuable element takes place during overrun operation.

9. The arrangement of claim 1, wherein the control value of the drive signal for controlling the actuable element in the direction of an extreme position is maintained for a pregiven time which assures reaching said extreme position or a pregiven position close to said extreme position.

10. The arrangement of claim 1, wherein said actuable element is brought into a pregiven position within said normal operating range after ending the control of said actuable element.

11. The arrangement of claim 1, wherein the control of said actuable element takes place manually.

* * * * *